US005372334A

United States Patent [19]

Cuadros

[11] Patent Number: 5,372,334

[45] Date of Patent: Dec. 13, 1994

[54] LOCAL VERTICAL SENSOR FOR EXTERNALLY-GUIDED PROJECTILES

[75] Inventor: Jaime H. Cuadros, Hacienda Heights, Calif.

[73] Assignee: Hughes Missile Systems Company, Los Angeles, Calif.

[21] Appl. No.: 51,402

[22] Filed: Apr. 23, 1993

[51] Int. Cl.[5] ..... F41G 7/24; F41G 7/28; F41G 7/30

[52] U.S. Cl. ..... 244/3.11; 244/3.14

[58] Field of Search ..... 244/3.1, 3.11, 3.14, 244/3.13, 3.19, 3.23; 356/152; 342/7

[56] References Cited

U.S. PATENT DOCUMENTS

| | | | |
|---|---|---|---|
| 3,995,792 | 12/1976 | Otto et al. | 244/3.14 |
| 4,003,659 | 1/1977 | Conrad et al. | 244/3.11 |
| 4,047,816 | 9/1977 | Pell et al. | 356/152 |
| 4,072,281 | 2/1978 | Miller, Jr. et al. | 244/3.16 |
| 4,096,380 | 6/1978 | Eichweber | 250/199 |
| 4,123,165 | 10/1978 | Brown et al. | 356/152 |
| 4,157,544 | 6/1979 | Nichols | 343/5 GC |
| 4,709,580 | 12/1987 | Butts, Jr. et al. | 73/178 |
| 4,990,918 | 2/1991 | Michelson et al. | 342/7 |

FOREIGN PATENT DOCUMENTS

| | | | |
|---|---|---|---|
| 56-125677 | 10/1981 | Japan | G01S 3/78 |
| 2041685 | 9/1980 | United Kingdom | G01S 17/66 |

*Primary Examiner*—Ian J. Lobo

*Attorney, Agent, or Firm*—Charles D. Brown; RAndall M. Heald; Wanda K. Denson-Low

[57] ABSTRACT

An improved local vertical reference determination technique for use with projectile guidance systems. The vertical reference determination apparatus uses a passive retroreflector mounted on the projectile to direct a portion of the incident electromagnetic radiation produced by a launching device transceiver as a return signal back to the launching device transceiver. A preferred embodiment of the invention employs a retroreflector having an axis canted with respect to the central axis of the projectile, such that the return signal is a function of the instantaneous angle of rotation of the projectile. The return signal therefore has a minimum magnitude at a first instantaneous angle of rotation and a maximum magnitude at a second instantaneous angle of rotation. The retroreflector is mounted on the projectile such that the return signal is at either the minimum magnitude or the maximum magnitude when the vertical axis of the projectile is aligned with the local vertical reference of the projectile guidance system. An alternate embodiment employs a retroreflector having a single facet. Another alternate embodiment uses a multifaceted retroreflector having at least two facets, where a first facet has a first coefficient of reflectivity and a second facet has a second coefficient of reflectivity substantially different from the first. The single-facet and multifaceted retroreflectors produce return signals having magnitudes strongly dependent upon the instantaneous angular position of the projectile.

7 Claims, 4 Drawing Sheets

LOCAL VERTICAL SENSOR FOR EXTERNALLY-GUIDED PROJECTILES

BACKGROUND OF THE INVENTION

1. Field of the Invention

This invention relates generally to projectile guidance systems, and more specifically to an apparatus that provides a local vertical reference for a remotely-guided projectile.

2. Description of the Prior Art

State of the art projectile guidance systems include one or more projectiles and one or more launching devices. Many present-day launching devices commonly include a guidance computer that issues control signals to the projectile. A plurality of control signals are used, and each signal corresponds to a particular projectile steering command. The projectile contains steering control hardware responsive to these control signals that steers the missile on a line-of-sight trajectory toward a desired target.

To generate synchronous steering commands for guiding a rotating projectile along a desired trajectory, the local vertical reference of the projectile is required. At least part of the vertical reference determination mechanism is usually mounted in the projectile or missile. Therefore, such mechanism should include hardware having relatively small size to minimally affect the aerodynamic properties of the missile. To minimize the amount of onboard hardware, it is desirable to situate at the launch computer as many components as feasible for the determination of local vertical reference.

Many prior art guidance systems derive vertical reference information from on-board gyroscopes. Although these systems are satisfactory for some applications, gyroscopes are not practical for small missiles of less than about 60 millimeters in diameter. Furthermore, gyroscopes are ineffective when employed in the context of roll-stabilized or other rolling or spinning missiles. Because of relatively high cost and complexity of gyroscopes, it is desirable to provide an improved alternative technique for the derivation of local vertical reference information.

Special considerations apply to the derivation of vertical reference information for high-velocity projectiles flying at about 3.5 km/sec or higher. One such consideration relates to projectile cooling. In general, the front surfaces of the projectile must be cooled to prevent erosion of the nose tip. Nose tip cooling is provided by using fluid or gas injection, or by transpiration into the airstream.

A second consideration applicable to high velocity projectiles concerns roll or spin. It is desirable to introduce a slow roll about the central axis of a high velocity projectile, not to stabilize the projectile but to cancel the net effect of aerodynamic forces arising from small asymmetries of the projectile nose and body. The necessary roll is from one to ten revolutions per second. Although various prior art projectiles require higher spin rates for stability, most present-day projectiles are sufficiently stable without such roll or spin.

A useful technique for controlling the trajectory of high-velocity projectiles is denominated "shock interaction steering". This technique operates by transmitting an injection control signal to the projectile. The injection control signal causes a fluid or gas to be injected into the airstream from the projectile at right angles to the airstream. The release of fluid or gas sets up a shock wave that exerts a force on the projectile. Depending upon the magnitude of this force and its distance from the projectile center-of-gravity, the force can rotate or translate the missile, or both. The injection control signal is synchronized with roll position by a remote steering command so that the resulting aerodynamic forces cause the desired motion. Synchronization requires the local vertical reference information to be available at the launch computer for use in preparing the steering command signals. In this manner, the injection control signals facilitate the achievement of a desired missile trajectory.

State-of-the-art methods for providing communications between the launcher and the missile involve the use of electromagnetic radiation. The launcher contains a transmitter for producing a signal composed of electromagnetic radiation having a predetermined wavelength, and a receiver responsive to this signal Electromagnetic radiation may include, for example, a continuous or a pulsed light wave. During system operation, the launcher transmit a signal toward the missile. The missile contains a reflector that returns a portion of the incident electromagnetic radiation to the launcher receiver.

FIG. 2 illustrates a side view of basic prior art retroreflector 138 that may be employed in the context of a missile guidance system. Optical source 208 at the launching site transmits a beam of optical energy through polarized mirror 207 toward the retroreflector. Optical source 208 is positioned relative to polarized mirror 207 so that mirror 207 is virtually transparent to the energy emitted by optical source 208. The optical energy travels through space and eventually intercepts first surface 143 of retroreflector 138. The optical energy incident upon first surface 143 is reflected to second surface 148 as shown.

The angle between the first surface and the second surface is approximately 90 degrees, such that second surface 148 reflects the incident optical energy back toward polarized mirror 207. During each of these reflections, the polarization of the optical energy changes. When the twice-reflected optical energy reaches polarized mirror 207, the energy is of such polarization that it is mostly reflected from polarized mirror 207 to optical detector 209. Optical detector 209 produces an output that is dependent upon the presence or absence of incident optical energy.

One example of a prior art projectile reflector is disclosed in U.S. Pat. No. 4,990,918, issued to Michelson et al. The reflector consists of a trihedral corner reflector arrangement having three planar faces at right angles to one another. The first planar face has a triangular shape, and contains a right angle that forms a common vertex. The second and third planar faces are joined along an inner edge to form a center line extending from the common vertex. The reflector is symmetrical about the center line.

The purpose of the Michelson reflector is to enhance the radar cross-section of fixed and moving targets. The cross-sectional pattern is enhanced in one plane, thereby improving radar detectability in that plane. However, the device does not provide local vertical reference information, nor does the device provide a signal return that is strongly dependent upon the roll of the missile.

Another prior art reflector is disclosed in U.S. Pat. No. 4,709,580, issued to Butts, Jr., et al. The Butts reflector includes two intersecting reflecting planes oriented at right angles with respect to one another, such that incident laser beams that are perpendicular to the line of intersection of the two planes are reflected directly back to the laser source. Each reflector therefore has a single retroreflecting plane perpendicular to the line of intersection. The retroreflector is mounted on a spinning object. Using a three-layered incident beam and a three-layered receiver, the rate of spin of the object may then be mathematically determined. Accordingly, the Butts reflector is designed for the purpose of ascertaining rate of spin. Butts does not disclose a technique for determining the local vertical reference of a moving object.

U.S. Pat. No. 4,047,816, issued to Pell et al., describes a technique for determining the attitude of a flight vehicle. Two ground-based laser transmitter/receiver stations are employed. A skewed reflector is mounted on the flight vehicle. As the vehicle rotates, each plane of retroreflected energy sweeps each of the ground stations at a time interval dependent upon the attitude of the vehicle. The reflector alignment on the surface of the vehicle is known, and the roll rate is measured by a signal reflected from the skewed retroreflector. This skewed reflector method of measurement is disadvantageous in the context of missile launching systems because two ground-based tracking stations are required to ascertain the roll rate of the vehicle/projectile.

A retroreflector development for use in the missile launching system environment is described in Miller, Jr., et al., U.S. Pat. No. 4,072,281. The Miller device employs a ground-based laser beam transmitter having a predetermined beam polarization. The missile contains a light detector that detects polarized light filtered through a prism. The output of the detector is processed by electronic circuitry mounted onboard the missile to determine the roll angle of the missile relative to the laser beam polarization axis at the launch site. In this manner, the vertical reference axis of a rolling missile may be obtained.

The Miller system does not disclose the determination of the local vertical reference of the missile through the use of a retroreflector having a canted surface or a single facet. Rather, the Miller system uses a prism responsive to incoming light waves of a predetermined polarization and requires the mounting of electronic circuitry within the missile. Thus, Miller discloses a missile with active onboard apparatus for determining the local vertical axis. This circuitry consumes valuable space within the projectile and increases the cost and complexity of each missile.

It is often desired to launch a plurality of missiles from a single launcher. Accordingly, it would be advantageous to locate hardware at the launcher whenever possible. The hardware mounted onboard the missile should be fully passive, such that all active, power-consuming electronic circuitry is contained at the launching device. A system such as Miller's that requires each missile to be equipped with hardware does not represent an economically efficient system. In general, it is much more economically efficient to build hardware once, for permanent use at the launcher, instead of constructing a plurality of expendable hardware devices for single use aboard a missile. Furthermore, the use of hardware mounted within the missile adds undesirable weight to the missile.

What is needed is a system that is capable of remotely determining the local vertical reference of a line-of-sight projectile. The system should require a minimum amount of hardware at the missile. The system should be equipped to determine The local vertical reference of a line-of-sight projectile from a single missile launcher site. Additionally, the system should be sensitive to the roll or attitude, or both, of the missile.

SUMMARY OF THE INVENTION

The improved local vertical reference determination apparatus of the present invention is employed in the context of a projectile guidance system. The system includes one or more projectiles and one or more launching devices. The projectile includes a central axis, a vertical axis, and selectively operable steering valve means for engaging in translational and rotational motion about the central axis such that, at any one instant, the vertical axis is situated at an instantaneous angle of rotation with respect to an arbitrarily defined reference position of the vertical axis.

The launching device includes an electromagnetic transceiver and a local vertical reference axis. The transceiver contains a transmitter for generating electromagnetic radiation of a predetermined wavelength, and a receiver for the reception of electromagnetic radiation transmitted by the transmitter. A command generator, coupled to the transceiver, issues projectile control signals to the transmitter.

The projectile is equipped with steering control hardware that responds to the control signals by operating the steering valve means. The steering control hardware performs the function of steering the projectile on a trajectory toward a desired target responsive to the control signals.

The vertical reference determination apparatus of the present invention operates in conjunction with the projectile guidance system described immediately above. The vertical reference determination apparatus uses a retroreflector mounted on the projectile at the projectile roll axis. This retroreflector is responsive to incident electromagnetic radiation produced by the launching device transmitter, directing to the launching device receiver a return signal comprising a portion of the incident electromagnetic radiation.

In a preferred embodiment of the invention, the retroreflector has an axis canted with respect to the central roll axis of the projectile such that the incident angle of electromagnetic energy and thus the return signal are functions of the instantaneous angle of rotation of the projectile. The return signal then has a minimum magnitude at a first instantaneous angle of rotation and a maximum magnitude at a second instantaneous angle of rotation. The retroreflector axis is canted at an angle with respect to the projectile roll axis such that the return signal is at either the minimum magnitude or the maximum magnitude when the vertical axis of the projectile is aligned with the local vertical reference of the projectile guidance system.

One alternate embodiment of the invention employs a retroreflector having a single facet. Another alternate embodiment uses a multifaceted retroreflector having at least two facets, where a first facet has a first magnitude of reflectivity and a second facet has a second magnitude of reflectivity substantially different from the first magnitude of reflectivity. In this manner, the single-faceted and multifaceted retroreflectors produce return signals having magnitudes strongly dependent upon the instantaneous angular roll position of the projectile except when incident energy is precisely aligned with the roll axis.

The vertical reference determination means of the present invention is advantageous because most of the required apparatus is situated at the launching device, rather than mounted onboard the missile. The only hardware required at the projectile is a simple passive retroreflector. It is desirable to limit the amount of hardware mounted within the projectile so as to minimally affect the weight and other aerodynamic properties of the missile and to minimize expendable components for improved cost efficiency. The missile-passive system of this invention satisfies all of the above desired criteria.

BRIEF DESCRIPTION OF THE DRAWING

The various features, objects, and advantages of the present invention will become apparent from the following more particular description thereof, presented in conjunction with the following drawing, in which.

DETAILED DESCRIPTION OF THE PREFERRED EMBODIMENTS

Figures 1, 2:
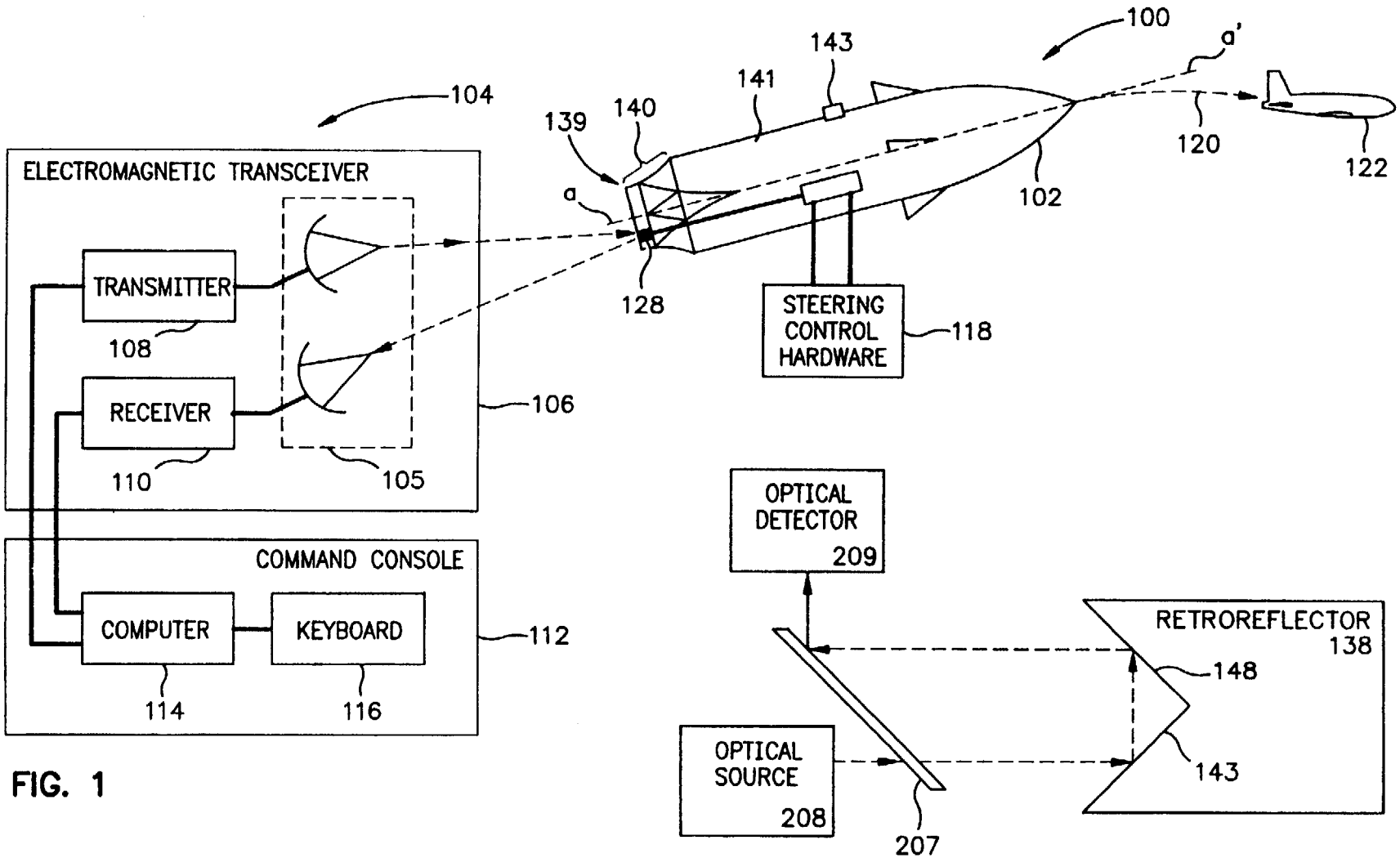
FIG. 2 PRIOR ART
FIG. 1 is a block diagram illustrating the operational environment of the present invention in the context of a projectile guidance system.
FIG. 2 is a side view schematically illustrating a prior art retroreflector structure.

With reference now to the drawing, and more particularly to FIG. 1 thereof, the operational environment of the present invention is shown in the context of projectile guidance system 100. Projectile guidance system 100 includes one or more projectiles 102 and one or more launching devices 104. Launching device 104 contains electromagnetic transceiver 106 having transmitter 108 for the transmission of electromagnetic radiation of a predetermined wavelength, and receiver 110 for the reception of reflected electromagnetic radiation transmitted by transmitter 108. The transceiver is illustrated as operating in conjunction with antenna system 105, but preferably operates at optical frequencies. The launching device also includes command console 112 for issuing projectile control signals. The command console may consist, for example, of computer 114 and keyboard or keypad 116. The keypad is used to enter data specifying a desired projectile trajectory. The computer processes the entered data to produce control signals operative on the projectile to control its trajectory.

The projectile contains steering control hardware 118, which is responsive to the control signals issued by computer 114 by way of the electromagnetic link. These control signals include steering commands that are used to steer the projectile on a line-of-sight trajectory 120 toward a desired target 122. The projectile has a central roll axis a–a′ running approximately in the direction of projectile translational motion. The projectile may be engaged in a rolling or spinning motion about this central axis.

Guidance system 100 includes a vertical reference determination mechanism for ascertaining the local vertical reference of the projectile. The vertical reference information is processed in command console 112 to derive steering commands for the projectile. The vertical reference determination mechanism includes retroreflector 128 mounted on the projectile. Retroreflector 128 reflects a portion of the electromagnetic radiation transmitted by transmitter 108 back to receiver 110. Retroreflector 128 operates as a projectile roll detector for detecting missile roll or spin.

The invention is employed in the context of a combination of launching device 104 and projectile 102. As projectile 102 leaves launching device 104, the back end 139 of the projectile is facing the launching device. The projectile is normally provided with a slow spin about its central axis a–a′. This spin is on the order of 10 to 100 Hz and serves the primary purpose of averaging high speed erosion. Introduction of this spin is neither necessary nor particularly useful for projectile stabilization.

Figure 8:
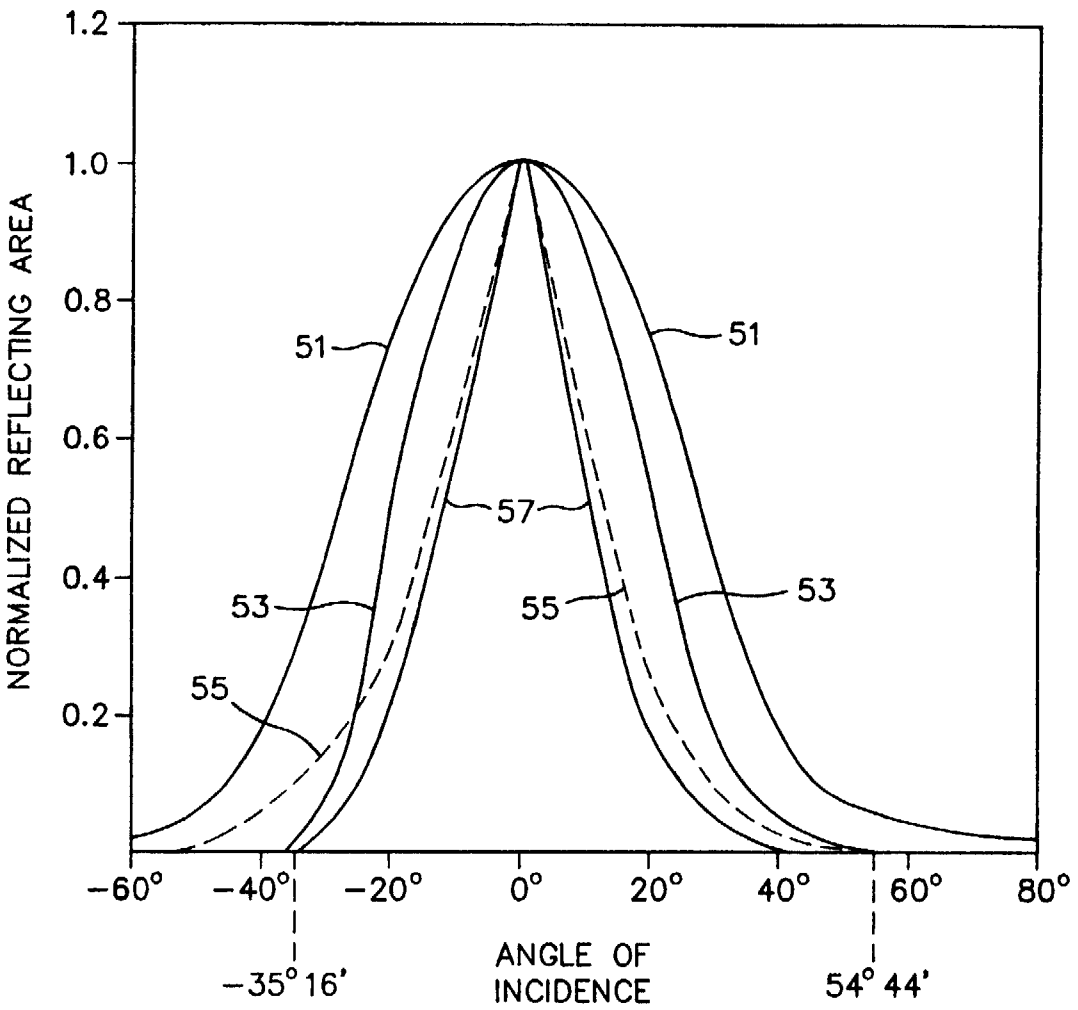
FIG. 8 is a graph showing the relationship between the normalized reflecting area and the angle of incidence for the retroreflector structures shown in FIGS. 3, 4, and 6.

If projectile 102 is engaged in spinning motion about its central axis a–a′, a conventional prior art reflector (for example, the reflector of FIG. 2) would return a constant signal independent of retroreflector roll angle, with some minor fluctuations related to the spin rate of the projectile and strong fluctuation related to angle of incidence (see FIG. 8). However, it would be desirable to design a retroreflector that provides a return signal strongly dependent upon the spin of the projectile. The structure of projectile 102/retroreflector 128 assembly may then be designed such that a minimum (or maximum) amount of energy is reflected back to transceiver 106 at the point in the spin rotation where the local vertical reference of the projectile coincides with the arbitrarily defined vertical axis of the guidance system.

Figure 3:
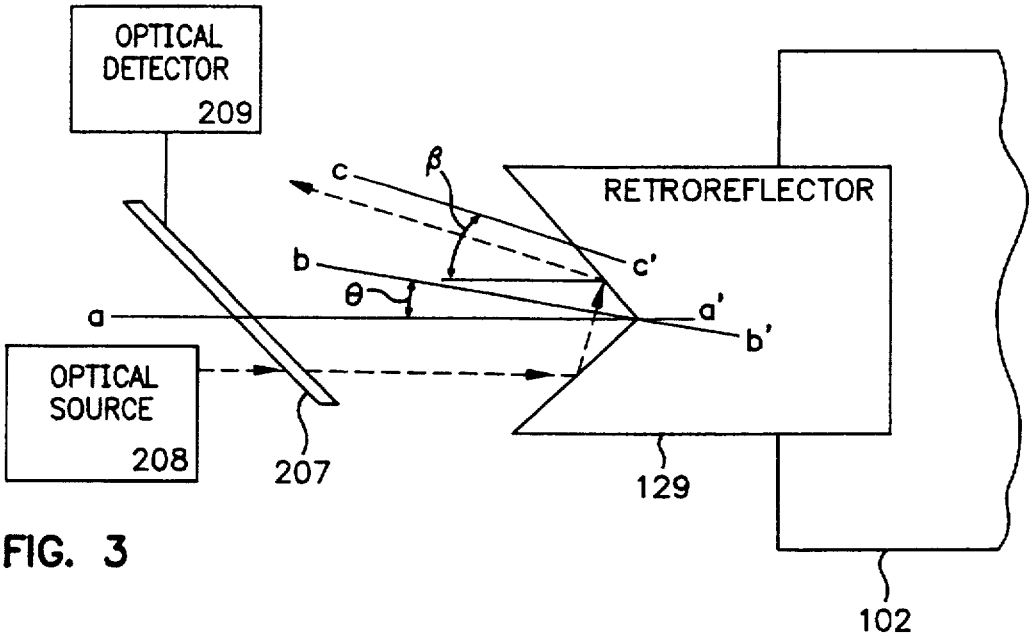
FIG. 3 is a schematic side view illustrating a canted retroreflector structure constructed in accordance with the present invention.

Retroreflector 129 constructed in accordance with a preferred embodiment of the invention is shown in FIG. 3. Axis b–b′ of the retroreflector is situated at an angle theta ($\theta$) with respect to central axis a–a′ of projectile 102. Therefore, retroreflector 129 may be denominated a canted retroreflector. Canting the retroreflector axis b–b′ with respect to the central axis a–a′ of projectile 102 results in a retroreflector having an angle of incidence and thus a signal return strongly dependent upon the instantaneous angle of rotation of the projectile. Retroreflector 129 is shown centered on axis a–a′, which is preferred because it produces a single signal minimum over a single full rotation. Placing it off of axis a–a′ produces two such minima, which unnecessarily increase the complexity of the decoding electronics in command console 112 (FIG. 1).

When projectile 102 rotates to the position shown in FIG. 3, the incidence angle theta ($\theta$) between axes a–a′ and b–b′ is at a maximum. Under these conditions, the optical energy transmitted by optical source 208 is substantially parallel to axis a–a′. However, the canted surface of retroreflector 129 reflects much of the incident optical energy along axis c–c' at an angle beta ($\beta$) with respect to axis a–a'. Much of the signal returned by the retroreflector traverses along axis c–c', never reaching polarized mirror 207 and optical detector 209. At this point in time, the optical energy detected by the optical detector 209 is at a minimum because incidence angle theta ($\theta$) is maximum (see FIG. 8).

Because of the design of retroreflector 129, as projectile 102 rotates the angle beta changes. When beta reaches a minimum value, the optical energy returned by retroreflector 129 is maximum because incident angle theta ($\theta$) is minimum. Accordingly, ,most of the returned optical energy reaches polarized mirror 207 and optical detector 209. Under these conditions, the detected optical energy is at a maximum.

The canted retroreflector design of FIG. 3 shows a simple technique for providing a return signal strongly dependent upon the instantaneous angular position of projectile 102. This dependency is weakest when axis a–a' is aligned with optical source 208 and strengthens as projectile 102 tilts away from alignment. By varying incidence angle theta ($\theta$) during projectile roll, the canted surface of retroreflector 129 provides projectile guidance system 100 with roll detection means. The roll variation effect may be obtained in any useful manner for the purpose of providing a retroreflector surface capable of indicating the instantaneous angular position of the projectile. For example, FIG. 4 illustrates an alternate embodiment of the invention in which one facet of a coaxially-mounted retroreflector 130 has been modified to provide a spoiling effect.

Figure 4:
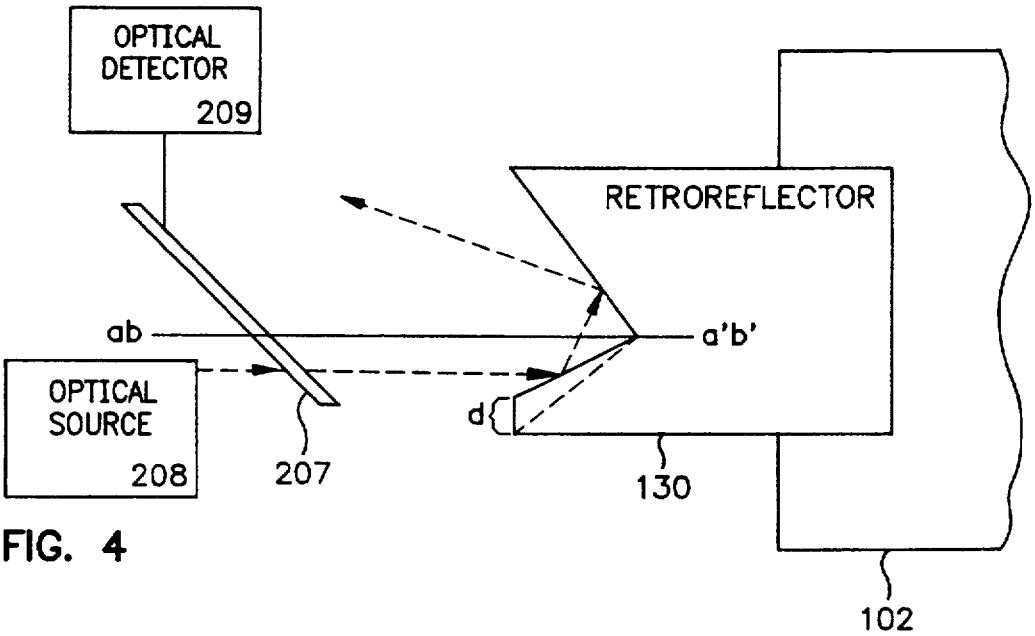
FIG. 4 is a side partial perspective view schematically illustrating a modified facet retroreflector structure constructed in accordance with the present invention.
Figure 5:
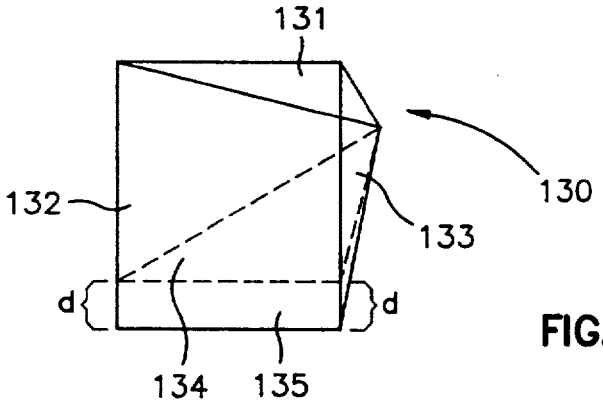
FIG. 5 is a partial perspective view of the modified facet reflector of FIG. 4.

Referring now to FIGS. 4 and 5, a side view and a perspective view of a modified facet of retroreflector 130 are shown. A conventional retroreflector design may contain, for example, four surfaces 131, 132, 133, 135 having substantially identical dimensions and arranged in a hornlike configuration. Such a retroreflector 130 would exhibit properties similar to those of the prior art retroreflector 138 illustrated in FIG. 2, in that the incident and reflected optical energy travel along substantially parallel trajectories. The return signal is therefore virtually independent of the instantaneous rotational position of the retroreflector at a fixed incidence angle theta ($\theta$).

The standard retroreflector design having four surfaces (facets) 131, 132, 133, 135 may be modified by changing the position of one of the surfaces, such as surface 135, with reference to the remaining surfaces. FIG. 5 illustrates the case where surface 135 has been positioned closer to surface 131 by distance d to form surface 134. Surfaces 132 and 133 are modified as required to accommodate the new position of surface 134. The modified retroreflector 130 has the reflective properties specified for the design set forth in FIG. 3, in that the retroreflector return signal is strongly dependent upon the instantaneous angular position of projectile 102.

Although FIGS. 4 and 5 illustrate a modified retroreflector structure in which the position of one of the prismatic retroreflector surfaces 135 has been changed from the symmetrical, the positions of a plurality of surfaces 131, 132, 133, 135 could be changed to provide instantaneous angular position detection means. Furthermore, there are various alternative techniques for modifying one or more of the retroreflector surfaces 131, 132, 133, 135 to produce a rotation-dependent return signal. For example, the coefficient of reflectivity of one or more surfaces or a portion of a single surface may be degraded, while relatively high reflectivity of the remaining surfaces is maintained. Reflectivity may be degraded by eliminating the reflective coating on selected surfaces or portions thereof, by coating selected surfaces or portions thereof with relatively nonreflective substances, or by totally eliminating selected surfaces or portions thereof. The aforementioned techniques may be combined, if desired, to meet certain specific system application requirements.

Figure 6:
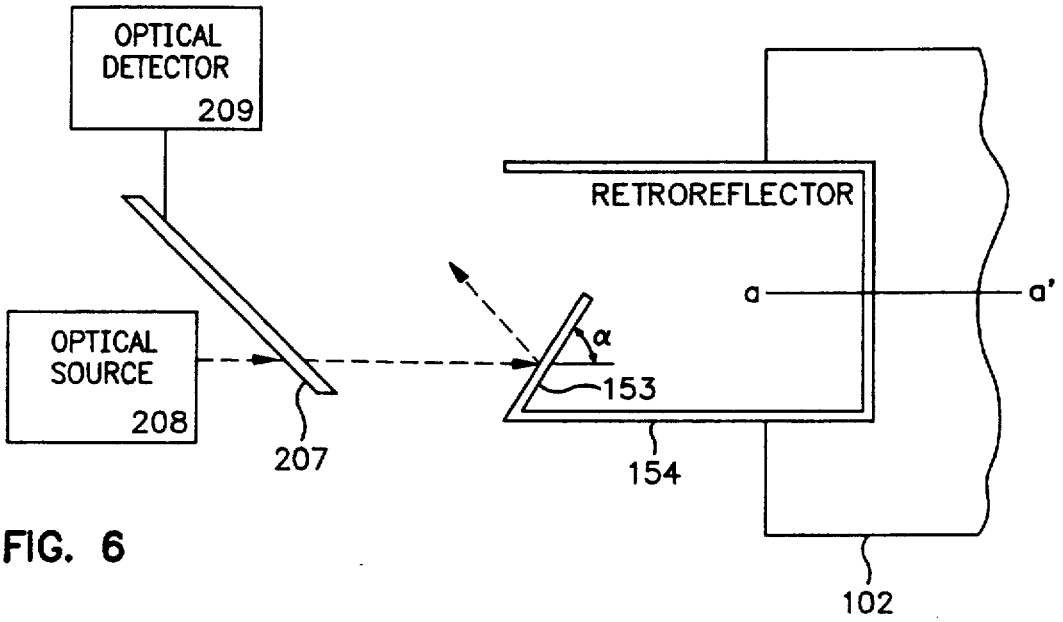
FIG. 6 is a schematic side view illustrating an alternative single facet retroreflector structure constructed in accordance with the present invention.

Referring now to FIG. 6, a further alternate embodiment of the invention is shown that uses single-faceted retroreflector 154 for the roll detector. This retroreflector contains single facet 153 mounted at an angle alpha ($\alpha$) with respect to projectile axis a–a'. The angle alpha is approximately 45 degrees, such that a relatively high percentage of the incident optical energy is returned to optical detector 209 during a first portion of one projectile revolution, and a relatively low percentage of incident optical energy is returned during a second portion of one projectile revolution. The intensity of this effect depends on misalignment of axis a–a' with source 208, which can be generally assumed. Other values for angle alpha are also useful.

Figure 7:
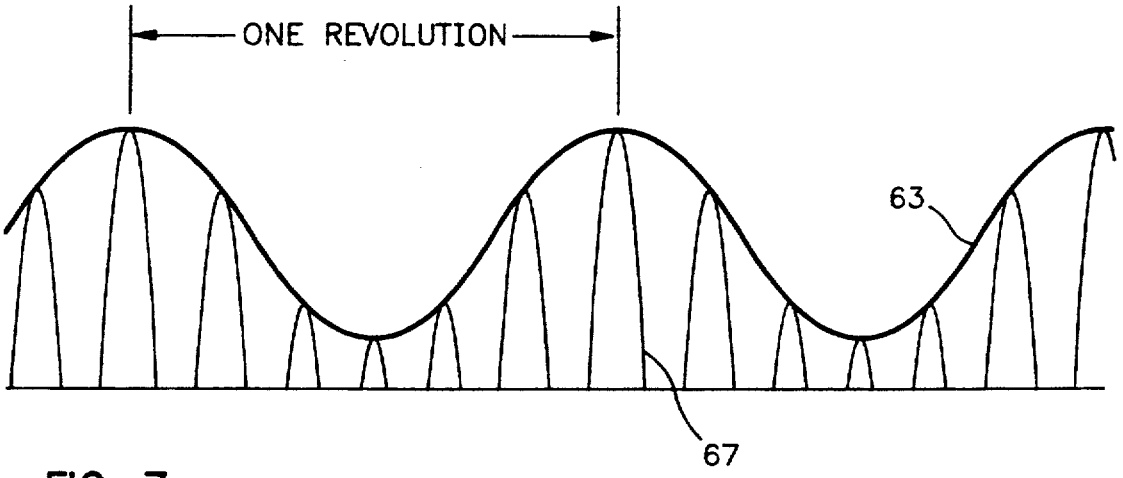
FIG. 7 is a graph showing the magnitude of the return signal from a rolling projectile versus time for the retroreflectors of FIGS. 3, 4, and 6.

The retroreflectors illustrated in FIGS. 3, 4, and 6 produce a reflection of electromagnetic radiation having a magnitude strongly dependent upon the instantaneous rotation angle of the projectile. It is common practice to refer to the instantaneous angle of rotation as projectile "spin" or "roll". FIG. 7 illustrates a typical return signal for the retroreflectors of FIGS. 3, 4, and 6. Curve 63 illustrates a return signal for a continuous-wave source of electromagnetic energy. The return signal oscillates at the spin frequency of the projectile. A source of pulsed electromagnetic energy produces a return signal composed of pulses 67. Note that the returned pulses 67 follow the sinusoidal envelope of the return signal for the continuous-wave source.

The local vertical reference of the projectile may be calculated from the projectile spin. One technique for determining local vertical reference from spin involves mounting retroreflector 128 (FIG. 1) on the projectile 102 such that the retroreflector returns a maximum (or minimum) amount of optical energy when the projectile is at a point in the spin rotation where the local vertical reference coincides with the defined vertical reference of projectile guidance system 100. In this manner, the retroreflector 128 projectile 102 combination of the present invention includes vertical reference determination means.

The vertical reference determination means of the retroreflector 128 projectile 102 combination operate in conjunction with the system components shown in FIG. 1. An oscillating signal, such as the signal illustrated in FIG. 7, is received by the transceiver antenna system 105, amplified, filtered, and demodulated by receiver 110, and then conveyed to computer 114. Computer 114 interprets the demodulated signal as establishing synchronicity for issuing one or more steering command signals required to keep the projectile on desired trajectory 120. The steering commands are fed to transmitter 108, where the commands modulate a carrier wave consisting of electromagnetic radiation. The modulated carrier comprising a control signal is transmitted toward the target zone by means of transceiver antenna system 105.

Launching device transceiver 106 provides a communications link between projectile 102 and launching device 104. A laser or an RF command link is the preferred method of communication from the launching device to the projectile during flight. Up-link communications are employed, such that transmitter 108 transmits a stream of pulses or a continuous wave signal to the projectile. Projectile retroreflector 128 is mounted in the base 140 of the projectile, such that the retroreflector is situated in the line of sight of the transceiver.

The transmitted control signal is received by steering control hardware 118 mounted onboard projectile 102. The steering control hardware contains circuits for opening and/or closing steering valves at a specified time interval after the projectile achieves a top dead center (vertical) orientation. The time interval is specified by the control signal transmission timing, which is determined with reference to the oscillating vertical reference signal such as shown in FIG. 7. Steering valves control the release of gas and/or fluid from the projectile, moving the projectile along the desired trajectory 120 such that it will hit target 122.

The steering of projectile 102 will be illustrated by way of example. The projectile is equipped with a first steering valve 143 mounted on surface 141. Assume that the projectile is spinning clockwise as viewed from the launcher, and it is desired to move the projectile to the left as viewed from the launcher. As soon as the projectile achieves a one-eighth rotation clockwise from top dead center, computer 114 sends a steering command to the missile specifying the opening of the first steering valve 143, releasing propellant. Computer 114 then commands the valve to close after the projectile achieves a one-quarter rotation clockwise from top dead center. The steps of opening and closing the valve may repeat as soon as the missile again rotates around to the top dead center orientation. These steps may be repeated until the computer determines that the new projectile trajectory intercepts the target.

First steering valve 143 uses gasses or fluids under pressure to effect the translation of the projectile with respect to the established trajectory. These pressurized fluids can be supplied by the same mechanisms that generate the gasses used to cool the projectile by transpiration. The transpiration cooling system for the hyper-velocity projectile requires a pressurized gas to be transfused into the nose cone area of the projectile or injected into the stagnation point of the projectile, as is known in the art.

When used for steering purposes, these pressurized gasses are injected into the air stream flowing past the projectile body. This injection can be accomplished by opening a valve under the control of the steering computer 114 and the steering control hardware 118 as discussed above. These fluids need not be cold and can be produced by a pyrotechnic gas generator and stored momentarily until released by the valves for cooling or steering. For steering, these gasses require only sufficient mass flow to interact with the air stream and induce a shock wave that attaches or presses on the body of the projectile to exert a steering action.

For projectiles having a relatively high spin rate, gas pressure steering valves are not useful. Instead, an explosive impulse system may be more advantageously employed. The explosive impulse system triggers the substantially instantaneous release, ignition, and explosion of a charge to correct the trajectory of the projectile. The steering forces are created by a very small explosive charge detonated under the control of the steering computer 114 and steering control hardware 118. The impulse from such detonation is transmitted to the projectile body through an attenuator. A number of these precision impulse generators (not shown) can be located in a ring on the periphery of the projectile, to be fired by the computer 114 at the proper time for steering in the correct direction. The duration of the explosive pulse is in the microsecond range. In practical missile guidance systems, perhaps two or three corrective explosive impulses are required to achieve target intercept.

Computer 114 is equipped with an algorithm to apply correction commands to the projectile over a number of revolutions. The computer then predicts the path of the projectile to the target, which is necessarily line-of-sight from launching device 104. If target intercept is expected, no further trajectory corrections are required.

The projectile retroreflector is designed to return a large percentage of the illuminating energy, almost independent of the angle between the retroreflector and transceiver antenna system 105. This angle may be termed the angle of incidence. FIG. 8 is a graph illustrating the effective area (cross-section) of the retroreflector as a function of the angle of incidence. The cross-section is the effective area that the retroreflector presents to the incoming wavefront in the direction of the incident radiation. Accordingly, the graph of FIG. 8 effectively illustrates the amount of energy returned by various retroreflectors as a function of angle of incidence.

Test results for four retroreflector designs are set forth in FIG. 8 for purposes of evaluative comparison. Curve 51 represents a solid triangular retroreflector with silvered mirror facets and a normalized reflecting area (N) of 100%. Curve 53 was prepared using a triangular retroreflector with an open design. Curve 55 is for a solid circular retroreflector with $N=1.0=100\%$, and curve 57 represents an open hexagonal retroreflector arranged in a full corner cube configuration.

In general, if an incoming wavefront meets a reflective surface head-on, that is, along a line normal to the surface, the presented area reaches its maximum value. As the angle of incidence departs from the normal, the presented area of the reflective surface decreases. In the context of missile retroreflectors, it is desirable to provide a reflective surface that minimizes the variations inherent in the presented area as a function of the angle of incidence. Under conditions of actual use, the projectile may not always be ideally situated with respect to the launching device. Therefore, a reflector surface having a relatively minimal variation in presented area as a function of angle of incidence provides superior projectile tracking capabilities.

The presented area of a retroreflector surface is generally proportional to the percentage of returned electromagnetic energy. Accordingly, the retroreflector of the present invention returns a high percentage of the incident electromagnetic radiation across a relatively wide range of incident angles. For example, a normalized reflective area of 50% can be achieved at ten degrees from center with a circular retroreflector (curve 55) and at thirty degrees from center with a triangular retroreflector (curve 51).

Figure 9:
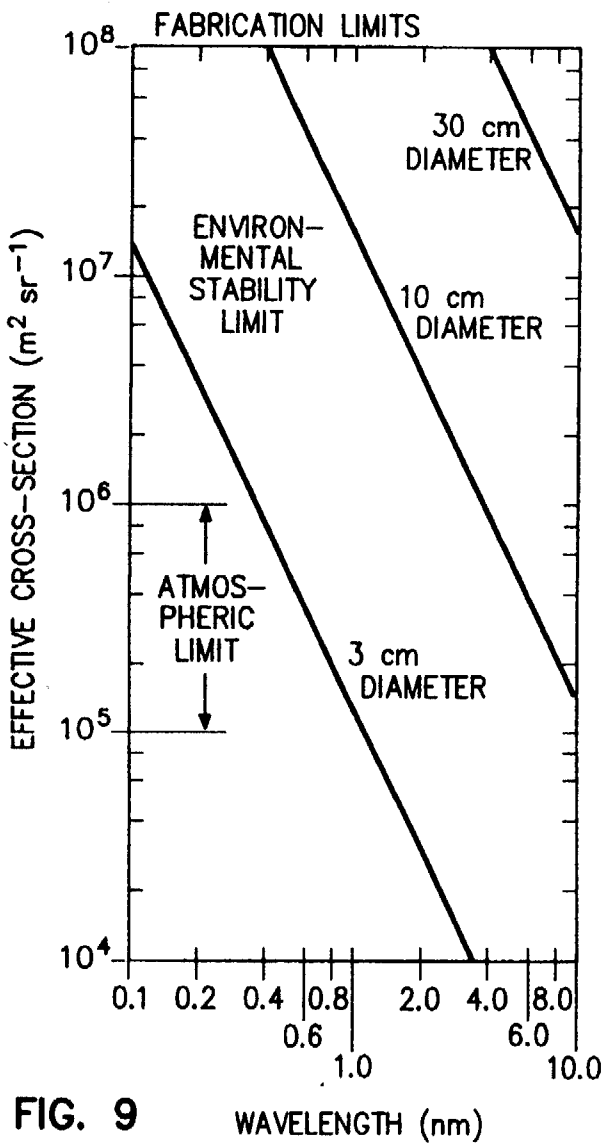
FIG. 9 is a graph showing effective cross sectional area versus wavelength for various corner reflector sizes.

The electromagnetic transceiver 106 may be equipped to operate in virtually any area of the electromagnetic spectrum, from very low frequency (VLF) up through the ultraviolet region. However, the frequency range including infrared, visible, and ultraviolet light (that is, optical wavelengths) provides a system having the advantage of small size. For such optical systems, the energy returned by the retroreflector is a function of wavelength. Shorter wavelengths, toward the ultraviolet end of the optical spectrum, result in relatively high energy returns. Longer wavelengths, toward the infrared end of the spectrum, produce lower energy returns. FIG. 9 is a graph illustrating the design limitations inherent in corner reflector configurations across various wavelengths. The required size for a retroreflector mounted on board a 60-millimeter diameter projectile is well within the design constraint limitations set forth in FIG. 9.

The use of optical wavelengths is practical in projectile guidance systems having a slant range up to about 10 kilometers. At greater distances, atmospheric attenuation increases to significant levels. For example, at a distance of 10 kilometers, atmospheric transmission at visible light frequencies is down by a factor of 10. The transmission is not a problem up to about a 10-kilometer slant range. Thus, it will be appreciated that FIG. 9 shows that a practical local vertical sensing system can be fabricated within the limits imposed by available fabrication accuracy, available dimensional stability in the operating environment, physical size limitations, and atmospheric coherence limitations. The useful physical size and atmospheric coherence limitations are shown substantially in the mid-region of FIG. 9.

A number of specific embodiments of the present invention have been described. Nevertheless, it will be understood that various changes and modifications may be made without department from the spirit and scope of the invention. Accordingly, it is to be understood that the invention is not to be limited by the specific illustrated embodiments, but only by the scope of the appended claims.

What is claimed is:

1. A local vertical reference determination apparatus for use with a projectile guidance system which includes:

(a) a projectile having a central axis, a vertical axis, and steering means for engaging in translational and rotational motion about the central axis such that, at any one instant, the vertical axis is situated at an instantaneous angle of rotation with respect to an arbitrarily defined reference position of the vertical axis; and (b) a launching apparatus for launching the projectile, the launching apparatus having a local vertical reference and comprising:

(i) electromagnetic transceiver means including transmitter means for the transmission of electromagnetic radiation of a predetermined wavelength, and receiver means for the reception of reflected electromagnetic radiation transmitted by the transmitter means; and (ii) command means, coupled to the transceiver means, for issuing projectile control signals to the transmitter means;

(c) the projectile further including steering control hardware responsive to the control signals issued by the transmitter means for controlling the steering means, the control signals operative on the steering control hardware to steer the projectile on a trajectory toward a desired target, said vertical reference determination apparatus comprising:

a retroreflector mounted on the projectile and responsive to the incident electromagnetic radiation produced by the transmitter means for directing a return signal comprising at least a portion of the incident electromagnetic radiation to the receiver means when the projectile is at some defined angle of rotation;

said retroreflector being shaped and configured such that the return signal is a function of the instantaneous angle of rotation of the projectile, the return signal having a minimum magnitude at a first instantaneous angle of rotation and a maximum magnitude at a second instantaneous angle of rotation;

said retroreflector being mounted on the projectile such that the return signal is at the maximum magnitude when the vertical axis of the projectile is at a predetermined angle with respect to the local vertical reference of the projectile guidance system.

2. The local vertical reference determination apparatus of claim 1, wherein said retroreflector has an axis which, when mounted to the projectile, is canted at a predetermined angle with respect to the central axis of the projectile, whereby the incidence angle on the retroreflector of the electromagnetic radiation varies responsive to roll of the projectile about its central axis.

3. The local vertical reference determination apparatus of claim 1, wherein the return signal is at a maximum magnitude when the vertical axis of the projectile coincides with the local vertical reference of the guidance system.

4. The local vertical reference determination apparatus of claim 1, wherein the return signal is at a minimum magnitude when the vertical axis of the projectile coincides with the local vertical reference of the guidance system.

5. The local vertical reference determination apparatus of claim 1, wherein said retroreflector comprises at least one first reflective surface having a first coefficient of reflectivity, a second surface having a second coefficient of reflectivity, said first and second coefficients of reflectivity being substantially different.

6. The local vertical reference determination apparatus of claim 1, wherein said retroreflector has an axis substantially coincident with the central axis and is configured with a plurality of surfaces, one of said surfaces being at an angle with respect to the axis of said reflector which is different from the angles of the remaining surfaces thereof.

7. A local vertical reference determination apparatus for use with a projectile guidance system which includes:

(a) a projectile having a central axis, a vertical axis, and steering means for engaging in translational and rotational motion about the central axis such that, at any one instant, the vertical axis is situated at an instantaneous angle of rotation with respect to an arbitrarily defined reference position of the vertical axis; and (b) a launching apparatus for launching the projectile, the launching apparatus having a local vertical reference and comprising:

(i) electromagnetic transceiver means including transmitter means for the transmission of electromagnetic radiation of a predetermined wavelength, and receiver means for the reception of reflected electromagnetic radiation transmitted by the transmitter means; and (ii) command means, coupled to the transceiver means, for issuing projectile control signals to the transmitter means;

(c ) the projectile further including steering control hardware responsive to the control signals issued by the transmitter means for controlling the steering means, the control signals operative on the steering control hardware to steer the projectile on a trajectory toward a desired target, said vertical reference determination apparatus comprising:

a retroreflector mounted on the projectile and responsive to the incident electromagnetic radiation produced by the transmitter means for directing a return signal comprising at least a portion of the incident electromagnetic radiation to the receiver means when the projectile is at some defined angle of rotation;

said retroreflector having an axis canted with respect to the central axis of the projectile such that the return signal is a function of the instantaneous angle of rotation of the projectile, the return signal having a minimum magnitude at a first instantaneous angle of rotation and a maximum magnitude at a second instantaneous angle of rotation;

said retroreflector being mounted on the projectile such that the return signal is at one of the minimum and maximum magnitudes when the vertical axis of the projectile is coincident with the local vertical reference of the projectile guidance system.

* * * * *